US008393288B1

(12) United States Patent
Ramsey

(10) Patent No.: US 8,393,288 B1
(45) Date of Patent: Mar. 12, 2013

(54) WATER VEHICLE IMPROVEMENTS WITH CONNECTING MEANS

(76) Inventor: James W Ramsey, Missoula, MT (US)

( * ) Notice: Subject to any disclaimer, the term of this patent is extended or adjusted under 35 U.S.C. 154(b) by 434 days.

(21) Appl. No.: 12/262,055

(22) Filed: Oct. 30, 2008

Related U.S. Application Data

(60) Provisional application No. 60/983,885, filed on Oct. 30, 2007.

(51) Int. Cl.
*B63B 7/00* (2006.01)

(52) U.S. Cl. ..... 114/345; 114/361; 440/6

(58) Field of Classification Search ..... 114/345, 114/352, 361; 440/6, 104, 106; 441/129, 441/130, 131; 135/88.01
See application file for complete search history.

(56) References Cited

U.S. PATENT DOCUMENTS

| | | | | |
|---|---|---|---|---|
| 1,517,745 | A | 10/1924 | Morley | |
| 3,324,488 | A | 6/1967 | Schulz | |
| 3,881,442 | A | 5/1975 | Seiple | |
| 4,650,432 | A | 3/1987 | Sainsbury | |
| 4,938,722 | A | 7/1990 | Rizley | |
| 5,046,978 | A | 9/1991 | Howerton | |
| 5,081,947 | A | 1/1992 | Holden | |
| 5,090,930 | A | 2/1992 | Walden | |
| 5,297,978 | A | 3/1994 | Ramsey | |
| 5,410,982 | A | 5/1995 | Mann | |
| 5,474,481 | A | 12/1995 | Ramsey | |
| 5,485,981 | A | 1/1996 | Lindahl | |
| 5,601,461 | A | 2/1997 | Mills | |
| 5,692,450 | A | 12/1997 | Alter et al. | |
| D393,683 | S | 4/1998 | Song et al. | |
| 6,142,839 | A | 11/2000 | Wilcox | |
| 6,345,744 | B1 | 2/2002 | Eldridge | |
| 6,490,989 | B1 | 12/2002 | Ray | |
| 6,575,798 | B2 * | 6/2003 | Maurel | 114/345 |
| 6,749,475 | B2 | 6/2004 | Howerton | |
| 6,860,220 | B2 | 3/2005 | Fleming | |
| 6,925,955 | B1 | 8/2005 | Brooks | |
| 6,929,521 | B2 | 8/2005 | Howerton | |
| 7,150,662 | B1 * | 12/2006 | Janitz | 440/6 |
| 7,314,399 | B2 | 1/2008 | Turner | |
| 7,357,688 | B2 | 4/2008 | Ferrara | |
| 7,418,919 | B2 * | 9/2008 | Smith et al. | 114/361 |
| 7,424,862 | B1 * | 9/2008 | Wagner | 114/361 |

* cited by examiner

*Primary Examiner* — Lars A Olson
(74) *Attorney, Agent, or Firm* — Sarah J. Rhoades

(57) ABSTRACT

The improvements of the present invention provide multipurpose and multi-functional improvements that enhance the functional utility of water vehicles. The combination includes connecting means which allow adaptation of a platforms, storage, and seating. An improved motor mount permits a motor to be protectively stowed until a hinge is actuated to rotate the motor 180 degrees for operation. The improvements also provide motor controls, an anchor and motor controls attached to a seat platform. A shelter hood assembly attaches in a selectable, collapsible manner giving an operator use and appearance configuration options, allowing the assembled hood to act as a barrier against weather elements in addition to supplying functional color components including wildlife decoys, camouflage, safety markings, diving insignia, or other aesthetic designs or coloring. These improvements target utility of the water vehicle, particularly for boating, fishing, hunting, scuba or skin-diving, wildlife viewing or photographing, and general outdoor recreation.

34 Claims, 15 Drawing Sheets

11a

11b

12a

12b

WATER VEHICLE IMPROVEMENTS WITH CONNECTING MEANS

CROSS-REFERENCE TO RELATED APPLICATIONS

This patent application claims priority under 35 U.S.C. §119(e) to U.S. Patent Application Ser. No. 60/983,885, entitled "Water Vehicle Improvements and Attachment Means," and filed on Oct. 30, 2007, which application is now pending. The entire disclosure of that provisional patent application is hereby incorporated by reference.

BACKGROUND

1. Field of Invention

This invention relates to inflatable tube water vehicles or floatation devices for use as a recreational boat, raft, fishing craft, a hunting blind, a scuba or skin-diving vessel, a wildlife viewing or photography station, or outdoor recreation vehicle.

2. Description of Related Art

This Inventor was among the first to significantly advance the art of personal floatation systems. He has two previous patent grants for his floatation system and its portability features. See U.S. Pat. Nos. 5,297,978 and 5,474,481. Prior inventions have attempted to provide seating accommodations, motor accouterments, and storage and wet well adaptations but further advancement of accessories and storage is needed.

BRIEF SUMMARY OF THE INVENTION

The present invention provides a combination of improvements to a water vehicle or floatation system with an inflatable tube having an annular tube wall such as the vehicles described in U.S. Pat. Nos. 5,474,481 and 5,297,978 to the Inventor. A zodiac or other boat or raft will also be improved by the present invention. The improvements have utility for an existing single passenger as well as a multi-passenger craft. The improvements comprise a connecting means adjoining the tube wall, a hood mounting and swivel means whereby a hood assembly is movably attached to the tube, a motor mounting means whereby a motor is mounted to the tube, a motor rotating means couples with the motor mount to translate the motor 180 degrees through a vertical axis from a stowage position to an operational position, and a motor control means whereby the motor rotating means and the motor are manipulated. Through the use of the connecting means, the floatation device may have a seat platform, floor, or any number of storage units removably attached to its tube wall. The combination of the connecting means, hood, and motor enhancements allow for platforms, storage, seating, access, motoring, anchoring, aesthetic and shelter improvements for a water vehicle. These improvements target utility of the water vehicle, particularly for boating, fishing, hunting, scuba or skin-diving, wildlife viewing or photographing, or other outdoor recreation.

The improvements further comprise an accessory group providing a pet, hunting dog, or standing platform; an insertable floor surface; a collapsible shelter hood assembly; a hunting blind or decoy; a single or double portable and adjustable seat; a network of connecting means; a motor mount for an aft or fore motor; and a motor rotating means to move, trim, and lower the motor from a stowage position to an operation position; a related motor controls, an anchor and anchor control for ease of operator control from a seated location. This accessory group of improvements heightens and expands the functional utility and operator convenience of a water vehicle. Because the improvements are intended to be used in combination with the floatation systems previously disclosed and claimed, they may be collapsed, folded, and placed in a removable, dry duffel day pack or backpack. Alternatively, they may be presented in full size embodiments which provide optimal functionality even if sizing is sacrificed.

The shortcomings of the prior art have been complicated by a lack of attachment options for these types of craft. Effective storage behind and in front of the seat has not been achieved in the prior art. As a point of the novelty provided by the present invention, the accessory group is accompanied by connecting means around the periphery of the inner and outer tube walls. The improved water vehicle of the present invention provides enhanced water vehicle function, offering the operator more options in the system's utility. The present invention provides a plurality of connecting means for installation of the improvements on the floatation system or water vehicle. The connecting means of the present invention are desirably located around at least the interior wall of the entire vehicle. The connecting means may occur on the exterior as well as interior of the water vehicle. The present invention connecting means occur at various elevations and horizontal stations within the water vehicle. The connecting means also occur behind and in front of the seat. In the preferred embodiment, the connecting means occur in a woven pattern around the interior circumference of the water vehicle. In one embodiment of the present invention the connecting means occur in the form of a network of straps which may be woven. In another embodiment, the connecting means occur at three parallel elevations or levels on the tube walls. Other variations such as single, double or even quadruple elevation and/or elevations are possible and contemplated or will be obvious in light of this disclosure. Additional connecting means are also provided on the exterior of the vehicle and have particular utility in the scuba or skin diving applications. The connecting means meet the long felt need for attachment points for storage accessories behind and in front of seats.

The connecting means have added the capability for portable seating conversion. An adjustable seat or seat platform may be adapted to be installed with the connecting means at any elevation or station in the water vehicle. Desirably, more than one seat may be installed at any elevation or station allowing use by more than one individual—a single passenger craft may become a multi-passenger craft. The present invention substantially improves the seat previously provided for a water vehicle. Furthermore, the connecting means with adaptability to various elevations provide for the attachment of platform accouterments and storage accessories around the seat area. Previous water craft models have a fixed ledge behind the seat at mid-seam. Now, waterproof storage can be placed between mid-seam and the raft bottom or under the seat and securely attached or can also be attached at mid-seam to the top of the raft, not only behind the bow seat but behind a stern seat. On the other hand, a large continuous storage accessory can be attached between the top of the raft and the bottom.

The present invention involves a planar surface removably attached to the water vehicle by the connecting means. The surface may be inflatable and may serve as a removable, self-bailing floor when applied with the assistance of the connecting means provided herein. Such a removable floor is desirably designed to be used over the entire bottom or over only a portion of the bottomless water vehicle for certain applications. A flat, inflatable surface or floor may be attached to the water vehicle by the connecting means or by additional means such as a zipper. In any case, the surface meets a need for a floor to be removable and employable in portions or in its entirety. The improvements provide a means of converting the patented floatation system to a vehicle with a bottom, center, or surface deck. A bottom deck may serve as a self-bailing floor similar to those enjoyed by common rafts. A center deck may serve storage objectives discussed above. A surface deck, discussed below, may permit the application of a sleeping or standing platform or pet transport.

The present invention contemplates the option for a rigid platform to be provided for access and use atop the inflatable water vehicle. The addition of a rigid component may enhance stability for uses such as standing. The connecting means permits for such a platform to be removably secured to the water vehicle. This rigid platform is tailored for use as a pet transportation accompaniment or as a deck upon which a user could stand for applications such as standing for fishing. The rigid platform is adjustable to be completely or partially storable such as through a folding plank formation known in the art. This particular feature will achieve functionality related to the hunting, fishing, and blind function for a station for either an individual to stand or a pet or hunting dog to rest and be quietly transported.

As discussed below, the improvements include an overnight shelter which pairs nicely with the sleeping surface to meet a need for a protected sleeping surface on a personal, inflatable, tube. The flat, inflatable surface of the present invention may be attached to the connecting means well above the water level to function as a sleeping platform. The platform may act as a mattress or allow a contained air mattress or other surface for sleeping. This sleeping surface may be attached to the internal wall at any number of the connecting means provided or by independent means such as eye rings or a waterproof zipper.

It has become apparent through use of the multi-sport flotation systems and water vehicles that there is ongoing need for advancements for extended use in the outdoors and on various bodies of water. Shelter is needed from elements such as sunshine, rain, or wind. Visual cover is needed from wildlife. The present invention seeks to address a need for shelter and visual cover so as not to be spotted by game and foul when hunting on land or water. Thus, a hood mounting and swivel assembly are a critical part of the accessory group and provide shelter to the user of the water vehicle which complements the improvements herein. The present invention provides a novel hood mounting and swivel means including a portable, collapsible assembly that can be simply erected and attached to inflatable water vehicles such as those described in U.S. Pat. Nos. 5,474,481 and 5,297,978. The hood mounting and swivel assembly means allows the user to control the coverage and position of the hood. The hood achieves these objectives by providing adjustment options such as quarter dome, half dome, three-quarter dome, or full dome. The swivel means for the hood can be attached or removed as needed from the pinned oar lock assembly.

The hood assembly may provide shelter and be an adjustable cover that can act as a sun visor, wind break, rain shield, or totally enclosed covering to protect against the elements or to provide configurations for the operator's convenience and desires. The present invention provides a unique ability to act as a hunting blind and a stylized animal decoy on a water body or on dry land. The frame of the hood may be configured in new forms or adapted for extensions which allow fabric cover designs and applications for game animal or waterfowl decoying or also a hunting blind. The frame also provides a reliable skeleton to support an ice house or tent shelter. Used in combination, the improvements, connecting means, and hood will allow use of the floatation system as an overnight sleeping shelter that may be used on the water, in marshes, or on dry land.

The cover of the hood meets aesthetic demands such as character designs or functional adaptations such as diving insignia or safety colors displays. The hood may be selected to give variable features in appearance including providing functional color components such as camouflage, safety markings, diving insignia, or simply other aesthetic designs or coloring. These features enhance the functionality and aesthetics of the floatation system for applications associated with outdoor activities.

As discuss more completely herein, the present invention sets forth a motor mounting and motor rotational means which will allow a motor to be affixed to a tube water vehicle. The present invention also provides a motor control in a remote location from the motor and preferably affixed in close proximity to the seat platform or on the upper tube wall of the water vehicle. The motor mount uses a unique method for stowing the propeller and later employing the motor with complete operator control. Additionally, an anchor is provided for the water vehicle. The anchor support is affixed to the seat platform and the anchor is disposed under the anchor support or under the ledge behind the seat. The anchor's control is preferably mounted on or in proximity to the seat.

The objectives of this invention are achieved through the improvement components and configuration options set out herein. The Inventor's prior water vehicles feature portability and easy assembly and disassembly options and these improvements align with and further those objectives. The present invention provides a water vehicle accessory group which may include a pet platform, portable and adjustable seat, motor mount fore or aft, insertable floor, sleeping platform and a collapsible shelter hood assembly with multiple embodiments. The present invention is an improved means by which to enjoy and use a water vehicle for fishing, hunting, boating, wildlife viewing, photography, and recreational outdoor experience.

BRIEF DESCRIPTION OF DRAWINGS

The following drawings further describe, by illustration, the advantages and objects of the present invention. Each drawing is referenced by corresponding figure reference characters within the "DETAILED DESCRIPTION OF THE INVENTION" section to follow.

Figure 1:
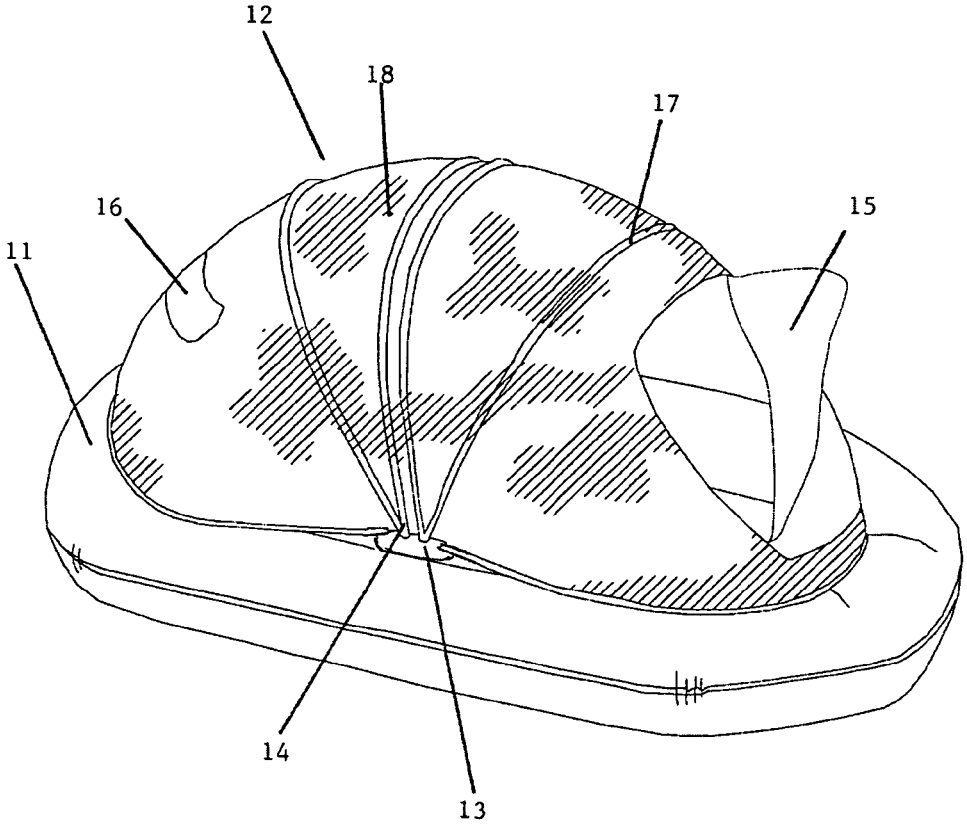
FIG. 1 is an exterior perspective view of a water vehicle with a patterned hood and showing the hood mounting and swivel means according to the present invention.

The present invention is embodied in several forms without departing from its spirit or essential characteristics. For the convenience of the reader, component numbering is provided in the detailed description whereby the first digit, or digits of the component number will correspond to the figure number at which that component is first or best illustrated. The scope of the invention is disclosed below and will be further defined in the claims and in the specific description preceding them. All embodiments are intended to be embraced by this disclosure.

DETAILED DESCRIPTION OF THE INVENTION

The present invention presents a combination of improvements to a floatation system which may be selectively employed by the user in order to enhance his experience with his water vehicle (herein used interchangeably with floatation system). The contemplated water vehicle to which these improvements may be applied is intended to be of similar construction to that of an inflatable tube. Typically, this tube will be formed in the shape of a ring or oval; however other shapes are known and contemplated such as open-ended ovoid shapes. Furthermore, a raft with substantially straight side walls, a rounded rectangular shape, or other shapes including any form with tipped or raised ends are also contemplated in the description of water vehicle.

Because the tube is expected to require inflation, it will be comprised of outer walls with air supplying the tube with buoyancy. For description of the present invention's improvement, the water vehicle will be discussed as having walls or tube walls. Such walls may occur in an annular formation and will discussed as such herein. The water vehicles of past inventions have provided bottomless interiors, fixed bottom interiors, or semi-covered, fixed bottom interiors. Most water vehicles provide either a seat or a seat platform traversing the bottomless interior; however, these improvements may be applied to water vehicles with or without a seat. The water vehicle, for which the improvements herein are disclosed, will not be described in further detail as water vehicles are already known in the art and claimed in the patents granted to the present Inventor. The ovoid shape of those inventions is most desirable.

The improvement of the present invention comprises: a connecting means affixed to the tube wall whereby any number of accessories may be removably adjoined to the tube, said accessories including a substantially planar and removable surface, a hood mounting and swivel means, a hood assembly constructed of a structural support and cover, a motor mounting means, a motor rotating means for translating or trimming a motor 180 degrees through a vertical axis, and a motor control means (which places the user in control of the motor and a motor rotating means), an anchor, and anchor control. The connecting means may occur in the form of a network of straps lying along the tube wall or may occur in plurality of individual bodies. In either case, the connecting means are attached to the tube wall. The motor mount is desirably a frame affixed to the seat of the water vehicle and extending over and out of the water vehicle. A motor is attached to the motor mount in a novel manner discussed herein and the user controls the motor from the motor controls provided in close connection with an anchor control. Each of these features are disclosed and claimed in detail herein.

Figure 13:
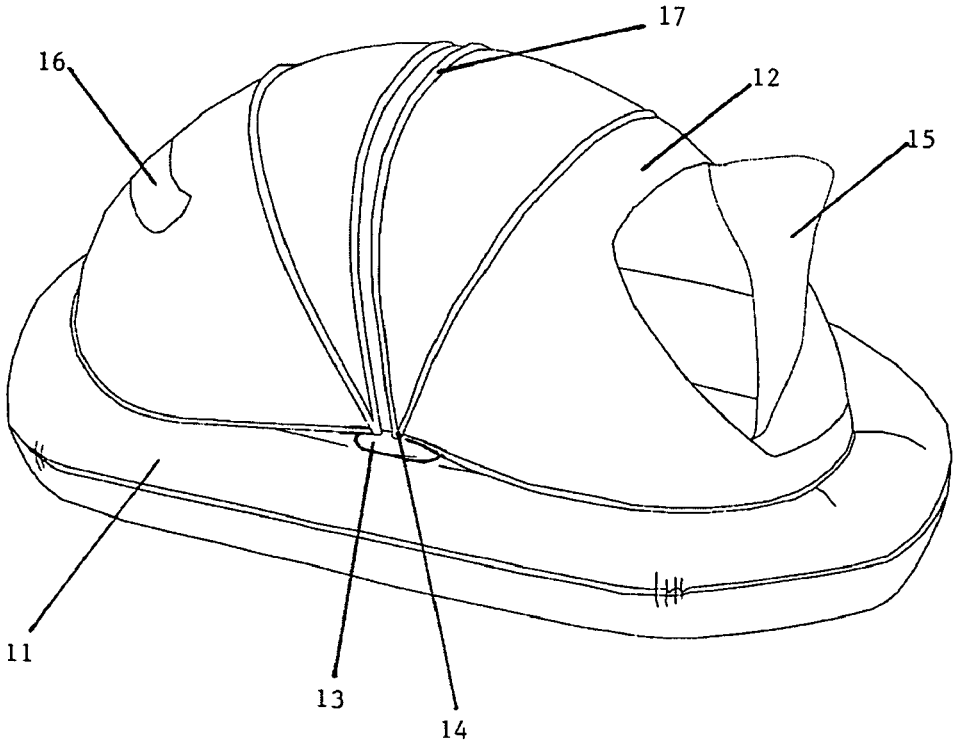
FIG. 13 is an exterior perspective view of a water vehicle with a solid-colored hood assembly according to the present invention and further demonstrating an access flap or side door, and window panel adaptations for the hood assembly.

FIG. 1 shows a water vehicle 11 with the hood mounting and swivel means 13 engaged to employ the hood assembly 12 in full canopy cover 18 and demonstrated in a camouflage pattern. Similarly, FIG. 13 illustrates a perspective view of a water vehicle 11 in a solid colored-embodiment. FIGS. 1 and 13 demonstrate the hood pivot point 14 and an exterior view of the hood mounting and swivel means 13 shown in more detail in FIGS. 5, 6, 7*a* and 7*b*. Also showing in FIG. 1 and FIG. 13 are access flaps including a side door panel 15 and a window panel 16. The window and door panels desirably have a securing means such as a zipper or other water-tight closure to allow for opening and closing of the panels. This drawing of the hood assembly 12 outlines the frame, further described as rods 71 by showing a rod silhouette 17. These embodiment variations provide added utility to a water vehicle 11, particularly when it is being used as a sleeping shelter, hunting blind, ice house or tent.

Figure 2:
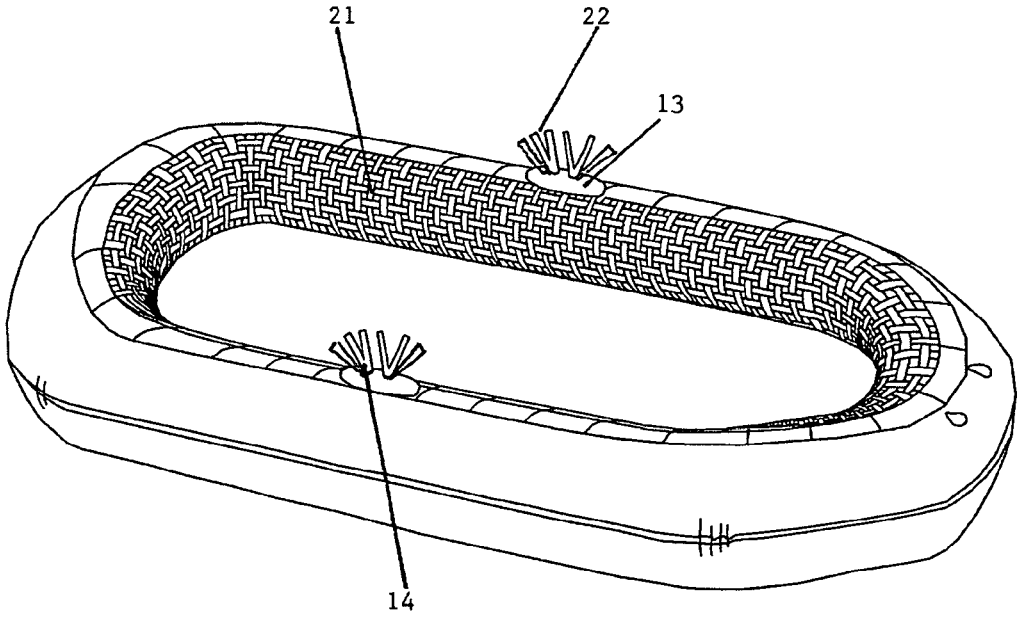
FIG. 2 is a side perspective view of a water vehicle with the connecting means and hood mounting and swivel means demonstrated without a hood engaged.

In FIG. 2 the hood assembly is removed to expose the novel adaptations of the present invention which make the improvements possible. The connecting means 21 in this illustration are shown in the preferred formation of a network. These particular connecting means 21 are straps woven at ninety-degree angles in a webbed netting or network and affixed around the interior circumference of the tube wall. The network is affixed to the tube in any manner appropriate to allow the network to lie flush against the tube wall. The straps will necessarily be constructed of a material with sufficient strength to hold a significant load, but flexible enough to allow engagement with some connecting instrument. In the preferred embodiment, the network of nylon straps are woven together at perpendicular angles forming a webbing which lies flush against the water vehicle wall wherein a seat, storage compartment and/or surface structure is secured for attachment to the water vehicle. Of course, other materials will satisfy the objectives of the present invention and may include rubber, elastomers, or other materials. The connecting means 21 necessarily provide for adaptation in all aspects and do so by providing various stations and elevations for connection of accessories spanning or isolated on the tube wall. One embodiment of the hood mounting and swivel means 13, a rod receiving structure 22, and the pivot point 14 of the hood assembly are exposed in this figure.

Figure 3:
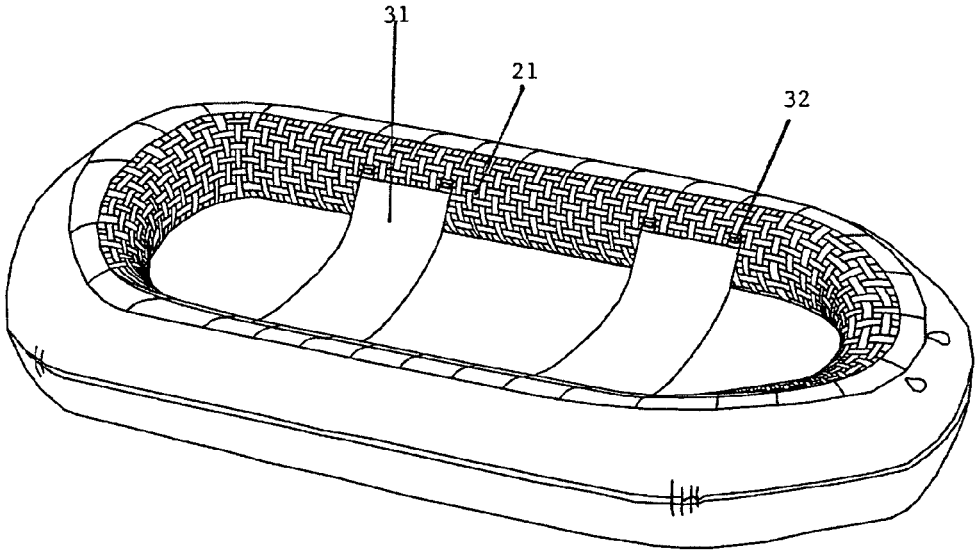
FIG. 3 is a side perspective view of a water vehicle demonstrating one manner in which to use the connecting means of the present invention.

As part of the novelty provided by the present invention, the improvements and accessories are made possible because of the connecting means 21. Other accessories will benefit from the adaptability of the connecting means 21. FIG. 3 demonstrates one manner in which to use the connecting means in conjunction with a bench seat 31 spanned between opposing tube walls. In this view, a connecting instrument 32 is shown as one manner in which to affix an accessory to the connecting means. Various instrument options for connection may include structures such as snaps, hooks, brackets, clips, lacing, or the like and will be apparent to those skilled in the art. Instead of a bench seat 31, a seat similar to the one in FIG. 8 may be attached to a seat platform 82 at any elevation and at any station, center, fore, or aft within the water vehicle. Any seat may be attached to the connecting means 21 even where the majority of the load is supported by the tube walls. A surface structure such as an inflatable floor, partial floor, sleeping platform, or self-bailing bottom will be described further herein and may be attached and secured by these connecting means 21.

Figure 4:
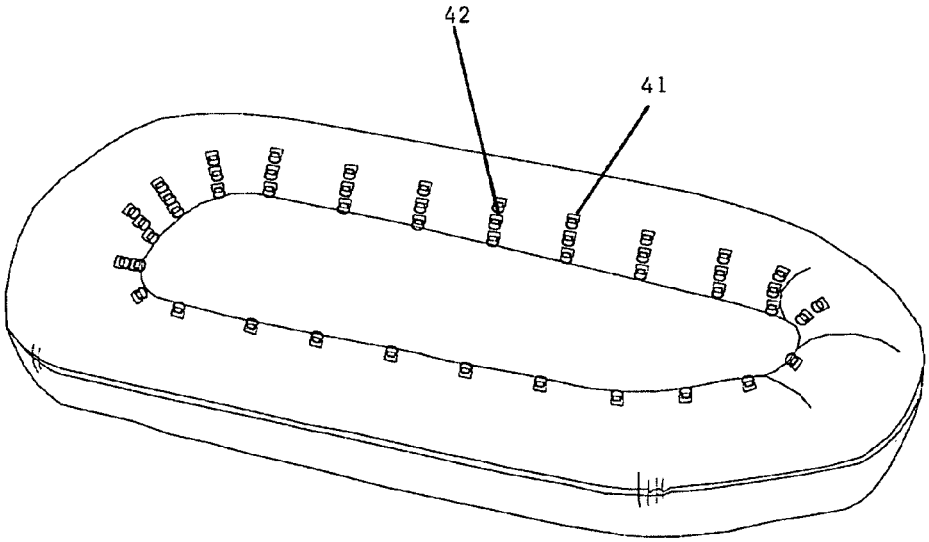
FIG. 4 is a perspective view of a connecting means according to one embodiment of the present invention.

Alternatives to the described webbed network are contemplated and will be obvious in view of this invention. FIG. 4 is a perspective view of a water vehicle and illustrates the connecting means 21 according to another embodiment which calls for straps 41 or sections of strap coupled with rings 42 or the like. The combination in FIG. 4 is glued or otherwise affixed at various elevations and stations around the water vehicle. This is only one embodiment for connecting means according to the present invention. In the another realization of connecting means (not shown), thick solid straps with pre-formed pockets serve as connecting means wherein rigid, ninety-degree panels attached to a seat, storage compartment, or surface structure are secured in the pockets for attachment. In this version, the straps are affixed to the boat with pockets at multiple elevations and stations along the water vehicle tube wall 31 around the interior circumference of the water vehicle. However, connecting means on the exterior of the water vehicle (not shown) are contemplated and may be desirable. Connecting means located on the exterior of the water vehicle will have particular utility for divers who wish to mount the water vehicle but need an easy location at which to dock their heavy tank and vest while they mount the vehicle from the water.

The connecting means of the present invention provide the needed utility for users of water vehicles to have maximum options for storage. Storage may occur in bags, containers, or platforms attached at various elevations or stations. The present invention particularly contemplates storage behind and in front of the seat 81 and seat mount 82. An example of platform storage behind a seat is that of ledge holders for scuba tanks and vest which may be secured by the diver before launch and then easily accessed by the diver while seated in a water vehicle. Storage behind the seat will also be vital when the water vehicle is being used for camping or backpacking, for example storage for carrying a cooler or ice chest. Dry storage is provided at upper elevations on the tube wall in order to transport or stow a battery for the motor. Connecting means at lower elevations are ideal for porting items which may be heavy but buoyant, or which are unharmed by water. Lobster or abalone gatherers may wish to have a bag to stow below or behind the seat. Connecting means located in front of the seat in the water vehicle will have particular use to hunters, fisherman, photographers, or others who wish to have some items close at hand as they recreate. Fisherman may want a net in front of them to land and hold fish or an apron to hold fishing accessories. Others may find utility in a working platform near the bow of the water vehicle. Other variations are contemplated and will be obvious in light of the addition of the connecting means and the disclosures made herein.

Figure 5:
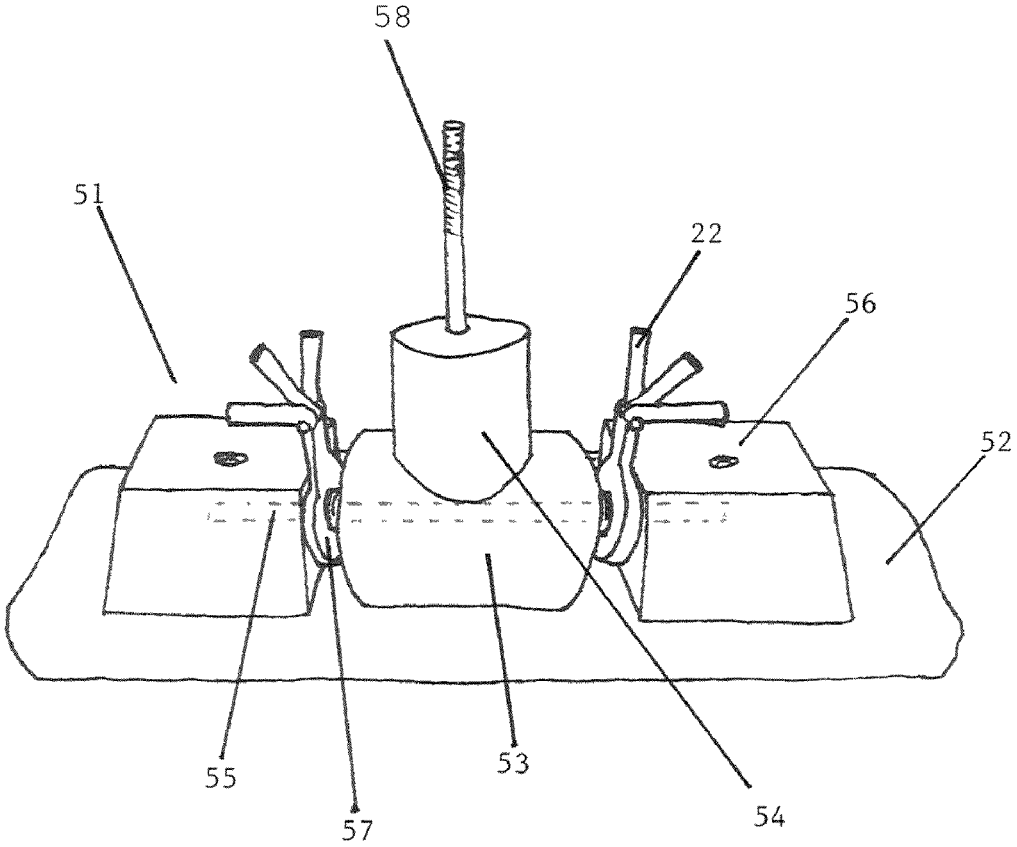
FIG. 5 is a front perspective view of hood mounting and swivel components according to one embodiment of the present invention.

The present invention calls for a rigid pivot point about which the hood may swivel. FIG. 5 is a perspective view of one embodiment of a rigid pivot point in the form of a mounting jig 51 as illustrated on a cut-away drawing of an isolated portion of the top of the tube wall 52. The mounting jig 51 comprises a horizontal first tube 53 coupled with a vertical second tube 54 mounted in near perpendicular orientation. The first tube 53 is transected by a dowel 55 which sits within a first and second thick-walled block 56 disposed on either side of the first tube 53. The dowel 55 and mounting jig tube assembly provide a pivot function to the jig. The dowel 55 may be movably integral to the blocks 56 and the first tube 53 affixed to the dowel 55—or the dowel 55 may be fixed to the block 56 and the first tube 53 movable with respect to the dowel 55. Disposed between the blocks 56 and the first tube 53 are receiving and swivel means 57 which provide the pivot point for the hood assembly and attach to the rod receiving structure 22. The hood assembly is not shown here but would be joined with the mounting jig 51 in a removable manner. The mounting jig 51 is attached to the top wall 52 of the water vehicle 11 by an adhesive, glue, or other coupling mechanism. In this embodiment, the mounting jig 51 serves as the stronghold for the entire hood assembly and this stronghold provides a structural receiver into which the rods of hood assembly may be received. The mounting jig 51 swivels through one axis as actuated by its dowel 55. The swivel means which receive the rods of the hood assembly swivel through the same axis. This dowel 55, acts as the linchpin about which the swiveling action provides the necessary pivot point for the frame rods of the hood assembly. The mounting jig components are desirably constructed of metal, plastic, or composite material. In this embodiment, the dowel 55 threads through the disk voids 75 of female receiving cylinders 62 (the structural receiver here) thereby engaging the swiveling components of the hood mounting and swivel means. In order to lock the hood assembly in a desired configuration, a locking pin, friction applicator, or fastener of a sort must be applied. In a later embodiment, the locking applicator is a wingnut. The female receiving cylinders 62 are demonstrated in FIG. 5 as prepared to receive the male engagement cylinders 72. The mounting jig 51 as shown in FIG. 5 also shows a means by which to engage an oar at the oar attachment point, called an oar pin 58 or pin oar lock. An oar lock may also have a separate swivel point that connects an oar, if desired, to the water vehicle.

Figure 6:
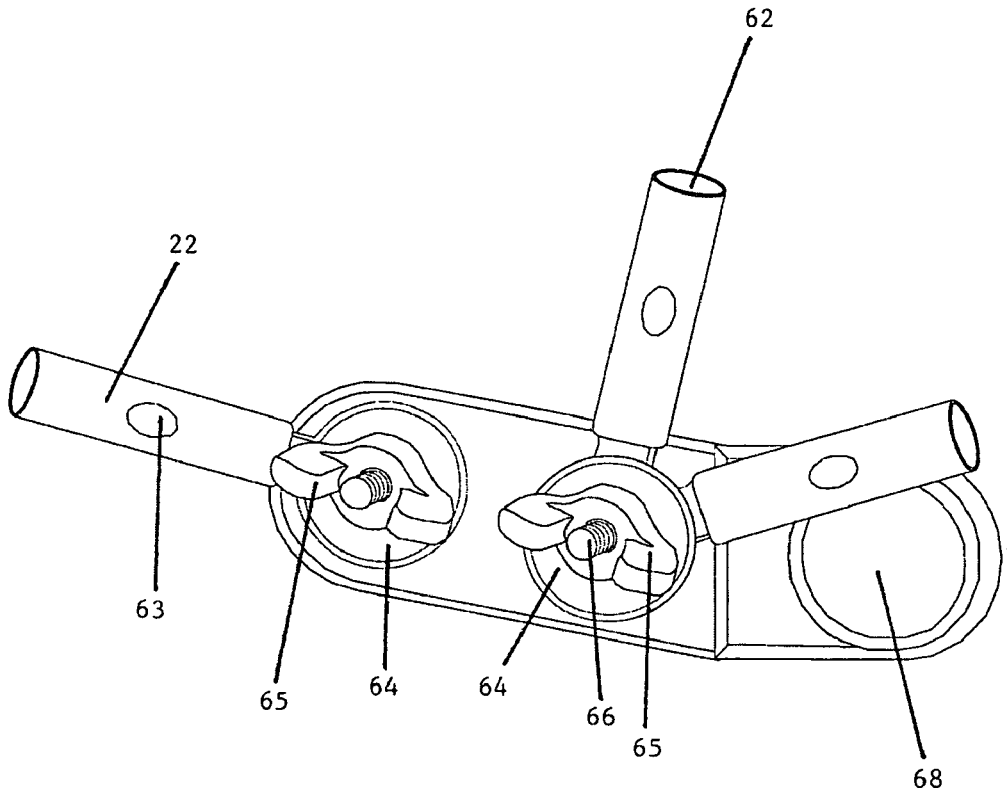
FIG. 6 is a detail perspective view of the mode of attachment for the hood assembly according to the present invention. The female receiving cylinders are shown without the corresponding male rods of the hood assembly.

A swivel means 57 is shown in isolated view in FIG. 6. For this embodiment, the swivel means is termed a hood lock assembly 61. This hood lock assembly 61 may be joined with the mounting jig of FIG. 5 by threading the dowel 55 through the jig opening 68 of the hood lock assembly, providing the pivot point 14 of the hood assembly. Through the combination of this hood lock assembly 61 and the mounting jig 51, a hood assembly 12 may be engaged with the water vehicle 11 until such time as one desires to disassemble the combination. Ideally, two or more hood lock assemblies 61 must be affixed to a water vehicle 11 at opposing positions on the tube such as those shown in FIG. 2. The rigid frame components of the hood assembly 12, herein called rods 71, give the hood cover its integrity and outline a sufficient spacial volume to cover the tube and accommodate at least one adult person. In the embodiment shown in FIG. 6, the swivel locking mechanism of the hood lock assembly 61 is a bolt 66 and wingnut 65 combination which may be threaded through the disk void 75 in the disk 64 at the end of the female receiving cylinder 62. The disk void 75 is visible in FIG. 7*b*. As demonstrated at one of the combinations in FIG. 6, the disks 64 and thus the female receiving cylinders 62 may be stacked by threading the voids 75 of multiple disks 64 holes, or disk voids 75, through the bolt 66. The rods 71 of the hood assembly 12 are moved and locked in place by the user releasing and tightening the wingnut 65 over the bolt 66 in the hood lock assembly 61. In another embodiment the jig opening 68 provides a point at which to stack and lock the structural receivers for the rods. These features may be replaced by functional equivalent technology whether known or obvious in view of this disclosure. The locking features may be provided by locking pins, ratchets, or any friction applicators. In addition to the hood lock assembly 61 and the rods 71 of the hood assembly the hood may also be secured by hood fasteners 144. Other variations will be obvious to those skilled in the art and are meant to be covered by this disclosure.

The rods 71 terminate in male engagement cylinders 72 shown in FIGS. 7*a* and 7*b*. The male engagement cylinders 72 are sized to fit inside the female receiving cylinders 62. The male engagement cylinder 72 may be inserted into the female receiving cylinder 62 and held fast in any manner. In one embodiment the male engagement cylinder has a button 73. When the male engagement cylinder 72 is joined with the female receiving cylinder 62, the button 73 is engaged in the hole 63 as shown in FIG. 7*b* by the engaged button 74. For more detail see FIGS. 7*a* and 7*b*. Optionally, the buttons 73 and holes 63 would not be necessary because the male engagement cylinders 72 may engaged with the female receiving cylinders by sizing and friction alone.

FIGS. 7*a* and 7*b* show the hood-supporting rod 71 combination in detail. In the hood assembly 12, the rods 71 are collapsible and covered with fabric or similar material constructed of cloth or a composite. The hood assembly 12 is configured by coupling the support rods 71 with the cover by any known methodology. One such method is known to be accomplished by inserting the rods 71 through a fabric guide (not shown) which guide is sewn or glued to the cover. The rod 71 may be any elongated cylinder composed of a single or several segments to be bent or telescoped from a short configuration to a long configuration that can be assembled in the field. In another embodiment, the hood will be supported by rod structures made of inflatable tubes within the hood cover. A preferred embodiment of the present invention calls for the hood assembly 12 to be made up of three to six support rods and corresponding swivel means on either side of the water vehicle.

Figure 7:
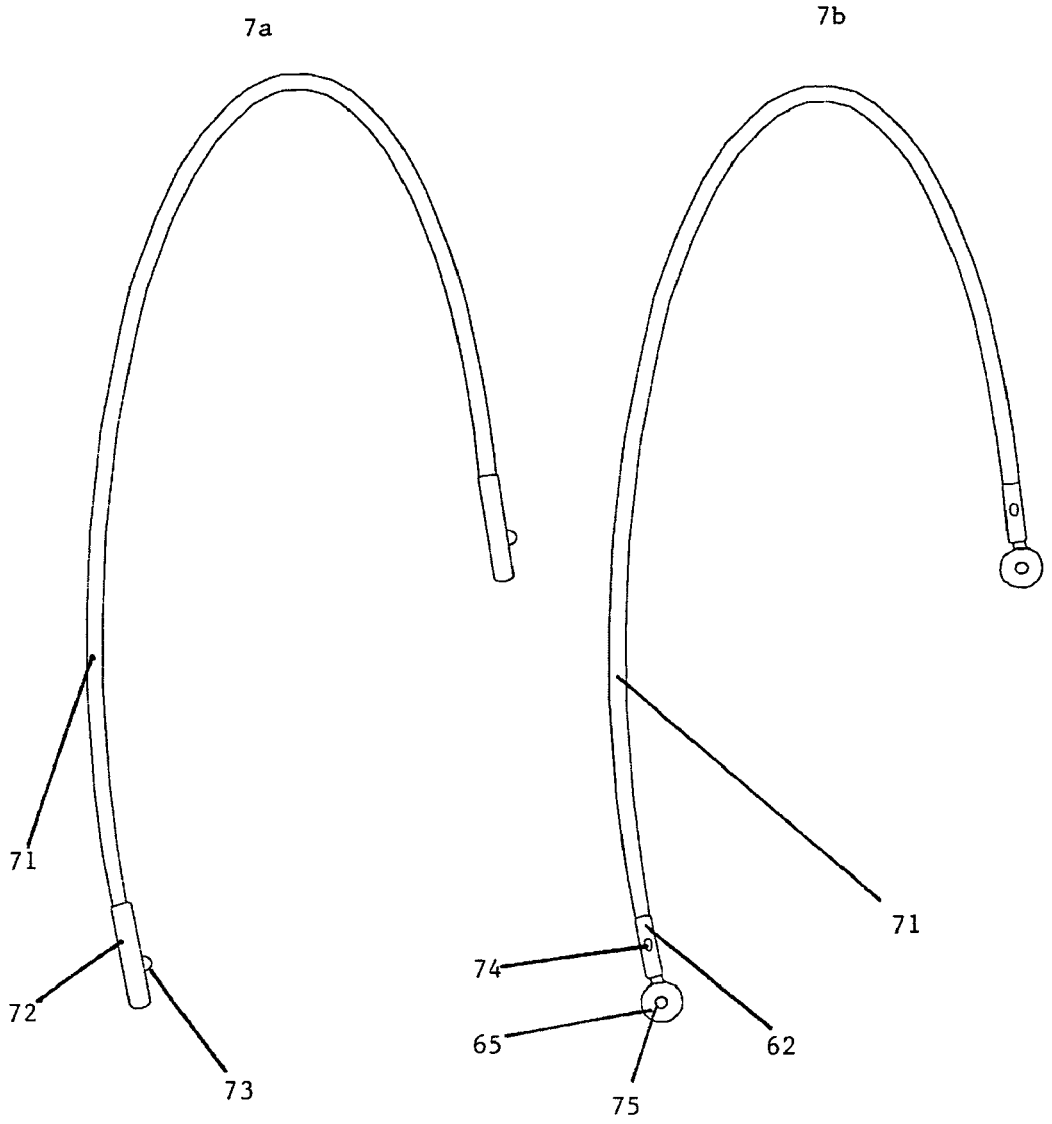
FIG. 7*a* is a side perspective view of the frame for the hood in the form of male rods of the hood assembly with their button securing means exposed.
FIG. 7*b* shows a side perspective view of the female cylinders shown in FIG. 6 with the male rods shown inserted therein. This combination is secured to the water vehicle with the bolt and wingnut combination shown in FIG. 6.

While FIGS. 6, 7*a* and 7*b* show in detail the subassembly of the hood mounting and swivel means as well as the hood swivel and locking assembly 51. One trained in the art and craftsmanship would be able to vary these components in order to achieve the functionality of the present invention. The representative diagrams shown in FIGS. 6 and 7, show one of several methodologies in design to achieve the functionality of mounting the hood assembly 12 to the water vehicle 11.

With the hood assembly 12 removed, one can better appreciate the features of the motor mounting means, the motor rotating means, the positioning of the anchor, and the control features for the motor and anchor as provided contemporaneously with the seat platform 82. Such a view is presented in FIG. 8. A seat mount or platform 82 is illustrated according to the preferred water vehicle embodiment. This illustration shows one portable and adjustable seat 81 and seat mount platform 82 for the water vehicle 11. Importantly, the motor mounting means is shown extending distally from the seat mount 82 by support of the frame member 83. In the preferred embodiment, the frame member 83 is constructed of a rigid material such as metal. The frame member 83 is bent and shaped to follow the bottom of the water vehicle and then the 'c'-curve of the tube wall of the water vehicle. After extending over the tube wall, the frame member plunges into the water before being bent at a 90 degree angle in order to terminate in a direction parallel with the surface of the body of water. The 90 degree bend may be accomplished by crimping the metal, bolting a separate L-bracket onto the frame, or any other methodology to create a comparable support bar which will also allow rudder movement and manipulation.

Figure 8:
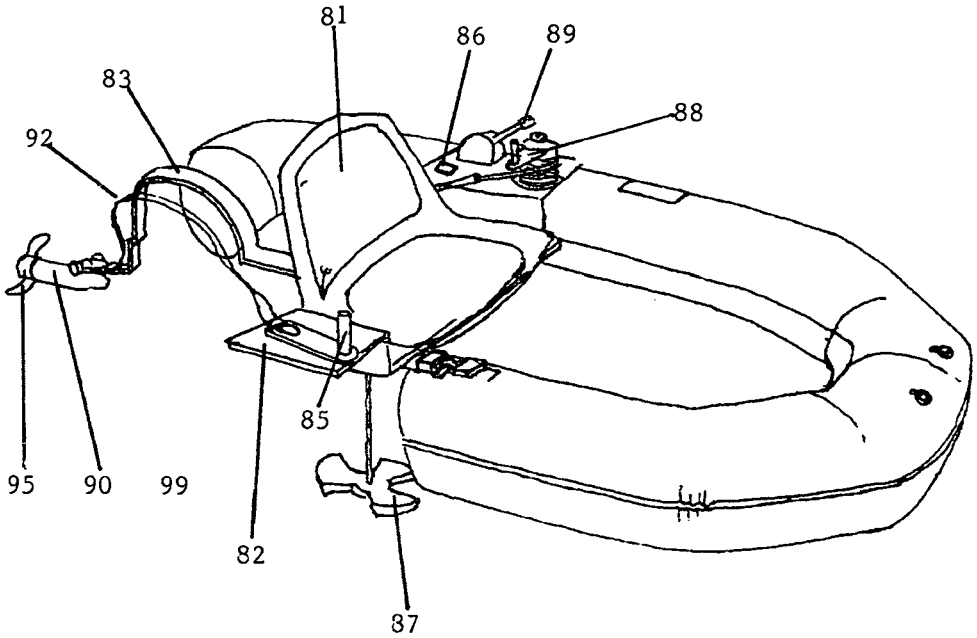
FIG. 8 is a perspective, cut-away view of a portable and adjustable seat, motor mount, motor, anchor, and seat mount with a motor and anchor control.
Figure 9:
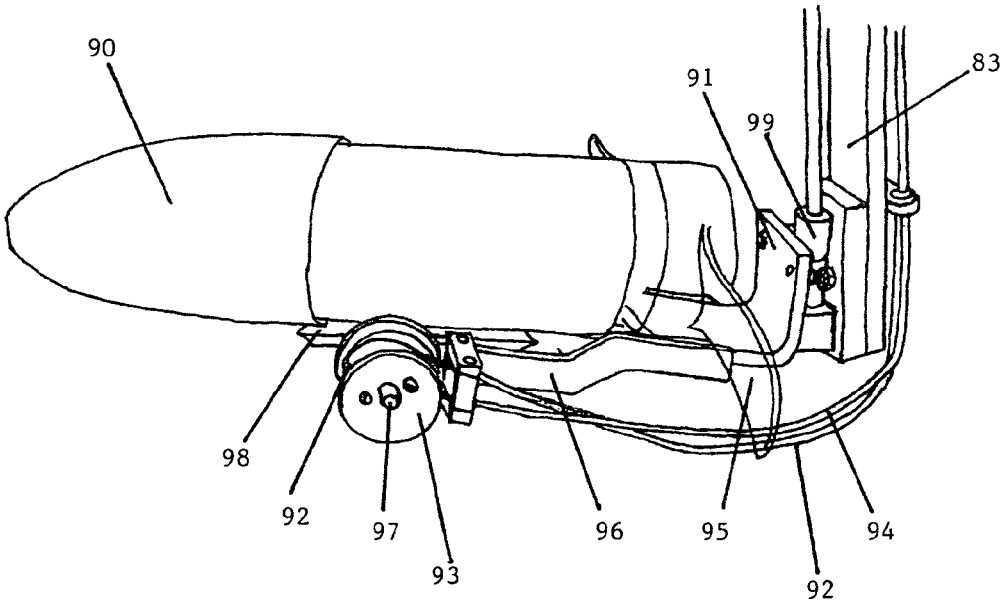
FIG. 9 is an enlarged view of the motor shown in FIG. 8 but showing the motor in its stowed position as compared with the engaged position shown in FIG. 8.

Referring to FIGS. 8 and 9 together will provide an understanding of the cooperation between the frame member and the motor rotating means. The motor is hingedly attached to the motor mounting means and a motor rotating means translates the motor through a vertical axis in order for the motor to moved into an articulated position for operation. In the preferred embodiment, the final portion of the frame member 83 attaches to an operational rudder mechanism 99 to control the direction of the water vehicle. The rudder affixes to the final section of the motor mount or the L-bracket 91 which provides a support bar of sufficient length to cradle the motor for stowage but not so lengthy as to compromise strength and thus functionality when the motor is articulated. A stowed motor is demonstrated in FIG. 9 while an articulated motor is shown in FIG. 8. As can be better visualized in FIG. 9, the end of the L-bracket is bolted to a motor cradle arm 96 which terminates in a hinging mechanism 97 the opposing portion of which is attached to the motor 90. A first control and a second control cooperate to actuate the motor hinging mechanism. The first control must be acted upon by an outside force and the second control reacts to that force. These components serve among the components of the rotating means which work together to rotate the motor 90 by one-hundred eighty degrees (180°) through a vertical axis.

In the preferred embodiment, the motor cradle arm 96 forks. A hinge pin traverses the distal opening of the fork and serves as the hinging mechanism 97 by conjoining with the motor base 98 and allowing an in-between space for the cable control of the motor to attach and repose. The hinging mechanism 97 is actuated by a wheel 93 coupled with a control cable 92 which together act to trim the motor when an outside force manipulates a first control, the rotational control. The rotation control 89 is set in proximity to the seat 81. The cable 92 attaches to the wheel 93 adjacent to the motor 90 and the rotation control 89 is located among the motor control features of the present invention in proximity to the seat 81. In the preferred embodiment, the cable 92 is the communicating means by which a user controls the hinging mechanism 97 and translates the motor 90 from its stowed, cradled position into its articulated, operating position. Desirably, the motor may also be an inboard or outboard motor with special trim features. A standard motor with a shorter shank customized for the water vehicle is also preferred and a shortened shank furthers the objectives of the present invention.

In the illustrated embodiment of FIG. 8, the seat platform 82 incorporates an anchor 87, an anchor control 88, and the motor control means. The motor controls are a set of control mechanisms which may include a control box, a rudder guide, levers, toggles, cranks, or the like. In FIG. 9, the control box 86 commands the motor speed which in this embodiment is communicated to the motor by a speed connection cable 94. The rotation control 89 in FIG. 8 is a lever that communicates with the motor rotating means when the user desires to use or stow the motor. The rudder guide 85 steers the water vehicle by use of any suitable methodology but in this embodiment is actuated by a rudder mechanism 99. The rudder mechanism is not visible in detail but couples the motor 90 with the motor frame 83 in a manner allowing for the horizontal panning and thus steering of the water vehicle. The crank 88 shown in FIG. 8 releases and retracts the anchor 87. All of the motor control means as well as the anchor control are disposed in proximity to the seat platform 82. In smaller water vehicle or other application of the present invention, a seat platform as illustrated in FIG. 8 may not be practical in which case the motor and anchor controls may occur on the seat or on the tube wall. The controls may either be above or below the upper surface of the tube of the water vehicle. The motor control means attached on the seat platform 82 allow the operator to raise and lower the motor 90 as well as provide stop, start, and speed control. In yet another embodiment, the seat 81 and seat platform 82 may not require a motor and associated motor control means. In an optional embodiment, the seat 81 and seat platform 82 may not require the use of an anchor 87. These aspects of the present invention provide operator convenience and, when included, may be a part of the seat platform 82.

The seat 81 is a standard portable and adjustable seat that is fastened to the seat platform 82 using spring clips or other fasteners that are attached to the seat platform 82. The seat platform 82 is made of lightweight, rigid and sturdy material such as fiber composites, or other similar material. In one embodiment, the seat spans the water vehicle's interior diameter so that it may be placed inside the vehicle and fastened to the tube surface of the inflatable water vehicle 11 at selectable elevation and horizontal stations via the connecting means of the present invention. The invention contemplates two different seats where the user may select a special or a standard seat option. In the preferred embodiment, the seat 81 will have hinges which allow it to fold down and become part of the standing platform disclosed herein. Another alternative provides a simpler seat 81 which may provide features and sufficient spacing to allow a user to attached more than one seat with the connecting means 21. Additional alternatives will be apparent in view of other seats in the art and this disclosure.

Figure 10:
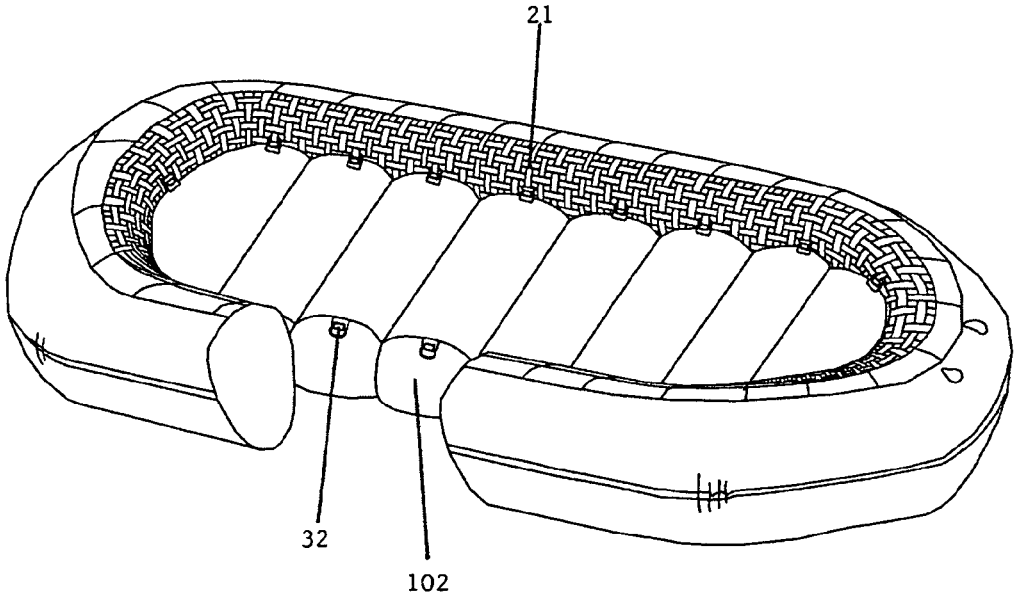
FIG. 10 is a side perspective and partially cut-away view of one embodiment of the present invention showing an inflatable floor attached to the connecting means provided by the invention.
Figure 11:
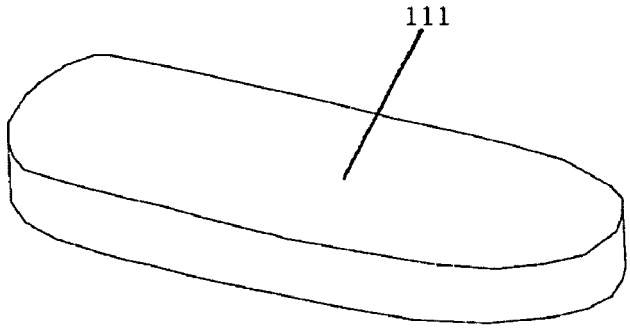
FIG. 11*a* is a perspective view of an inflatable floor or sleeping surface for insertion and attachment to a water vehicle.
FIG. 11*b* is a perspective, partial cut-away view of the inflatable floor or sleeping surface in place in the water vehicle at a middle elevation. A sleeping cover is shown in this illustration.
Figure 11:
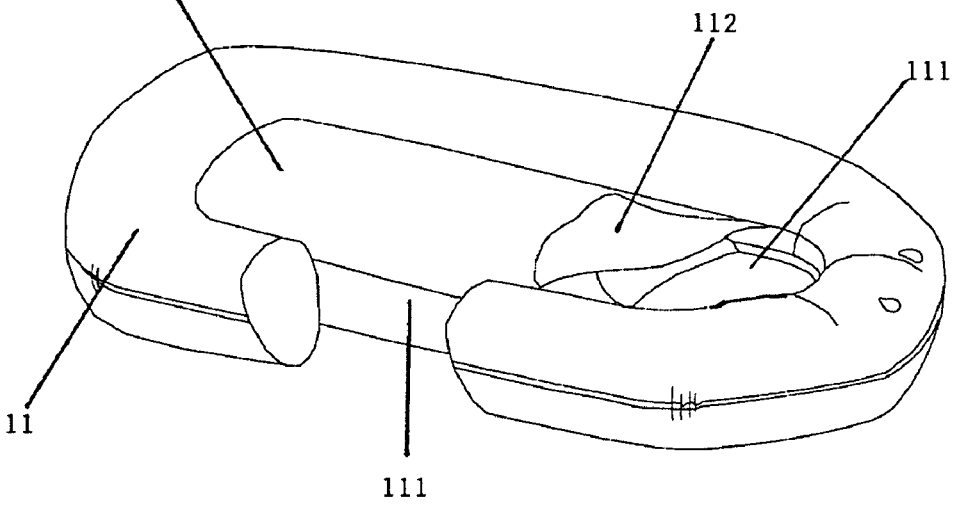

FIGS. 10, 11*a* and 11*b* demonstrate various embodiments of the substantially flat or planar surface or floor removably attached by the connecting means to close at least a portion of the bottomless interior of a tube. The surface is coupled with the water vehicle complementary to the improvements of the present invention and particularly the connecting means. As illustrated in the cut-away view the floor visible in FIG. 10 is an inflatable floor 102 attached to the connecting means 21 by an interlocking connection instruments 32 such as clips or snaps. One manner of attaching a self-bailing floor is by lacing the bottom with cables, ropes, or cords. The connecting means of the present invention may provide a natural coupling mechanism to receive such a lacing. FIGS. 11 and 11*b* show the inflatable surface 111 outside of and inserted into the water vehicle 11 with a sleeping cover 112 laying on top. This inflatable surface 111 is inflated, inserted, and secured to the water vehicle 11 tube wall by the connecting means 21 which are obscured from this view by the inserted floor surface. In another embodiment of the present invention the inflatable surface 111 is secured to the tube wall of the water vehicle 11 via a zipper or multiple zippers. One-half of the zipper is desirably attached at an elevation near the top of the tube wall and one-half of the zipper is desirably attached to the inflatable floor so that the two halves may cooperatively form a selectable, water resistant seam. Desirably, the dimensions of the inserted surface 111 are large enough to allow the floor to alternatively be mounted as a top deck via a zipper means secured to the upper tube wall. All fasteners, eye-rings, lacings, or ropes may be used or other types of fasteners can coordinate with the connecting means 21 (not shown here) of the present invention and to achieve the disclosed functional use as will be appreciated by those skilled in the art.

Figure 12:
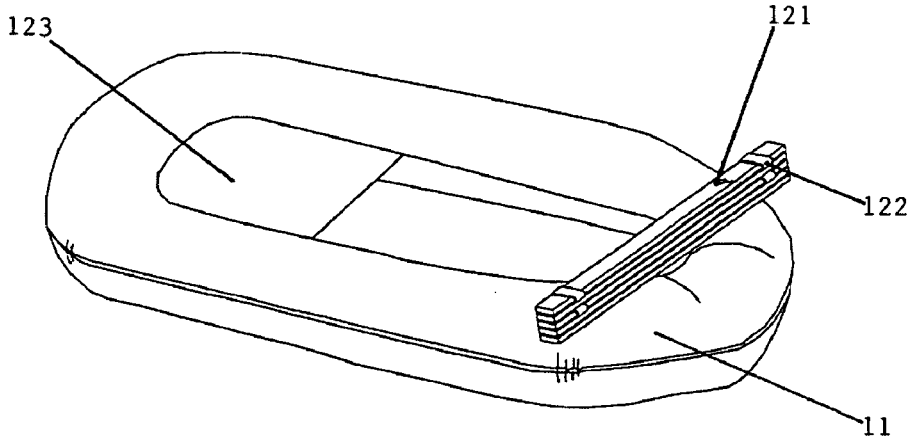
FIG. 12*a* is a perspective view of one embodiment of a platform assembly for use by pets or individuals to stand above the water level. It is mounted upon a water vehicle and unfolded for operation.
FIG. 12*b* is a perspective view of one embodiment of a platform assembly for use by pets or individuals to stand above the water level. It is mounted upon a water vehicle and folded for storage.
Figure 12:
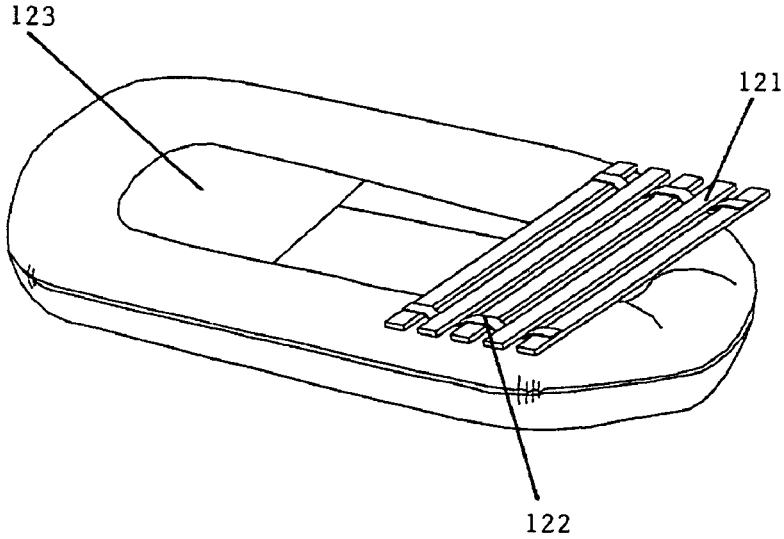

The present invention permits for a substantially flat surface to be applied at any elevation of the water vehicle. A preferred embodiment for the surface as applied on the upper levels of the water vehicle are shown in FIGS. 12*a* and 12*b*. This embodiment allows for a standing platform atop the water vehicle. An alternative embodiment may permit application of an inflatable floor for storage or support even at higher elevations. FIG. 12*a* shows one embodiment of the standing or pet platform assembly in which the planks 121 are held together using a ribbon belt 122 attached to each plank 121. The platform is attached to the water vehicle 11 using four fasteners (not visible), two on each end-plank. The platform is attached to the water vehicle using standard fasteners such as eye-bolts with tie downs, latch mechanisms or other types of fasteners which will coordinate with the connecting means 21 (not shown here) of the present invention. The planks 121 of the platform can be made of polymer material, wood, or other composite materials. FIGS. 12*a* and 12*b* demonstrate a partial floor 123 in application. Those skilled in the art will be able to construct this platform to obtain its functionality using any number of materials and folding and connecting means. FIG. 12*a* illustrates the platform assembly mounted on the water vehicle 11 in a laid-out position. FIG. 12*b* is a view of the platform assembly mounted on the water vehicle 11 in a folded position.

FIG. 13 shows the water vehicle 11 with the hood assembly 12. Key elements of the present invention shown in this figure are the hood assembly 12, an exterior view of the hood mounting and swivel means 13, the access flap 15, and window panel 16. The hood mounting and swivel means connects the rods 71 with the pivot point 14 and allows the user to control the position of the hood 12 in various configurations between full exposure and encapsulation. The rod silhouette 17 for a full enclosure is shown in this FIGS. 1 and 13. This figure (FIG. 13) shows the hood fabric in a solid print as compared with the patterned fabric cover in FIG. 1.

Figure 14:
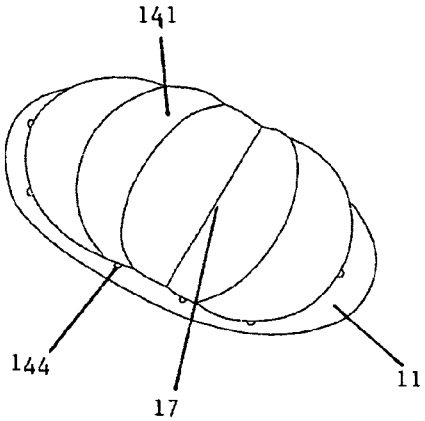
FIG. 14 depicts three top, perspective views of a water vehicle improved by a hood assembly of the present invention. The adaptability of the hood is demonstrated by the illustration of three different positions including the full dome, half dome, and sunroof configurations.
Figure 14:
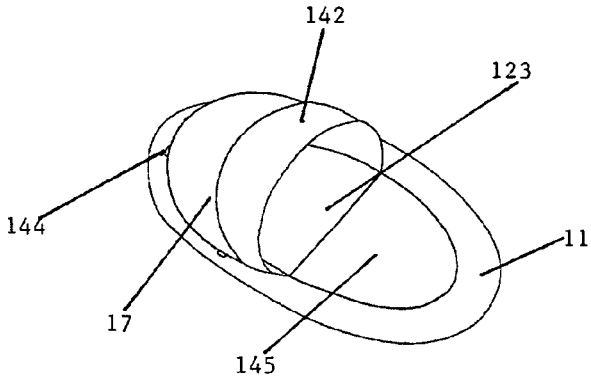
Figure 14:
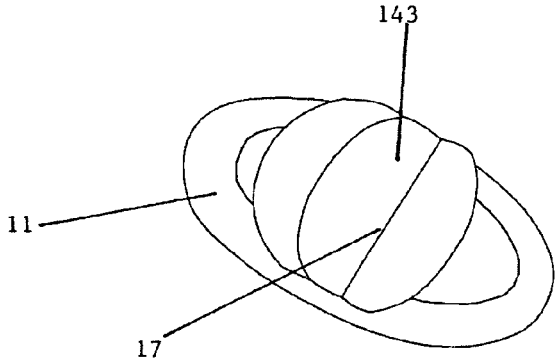

Various configurations of the assembly that may be achieved by adjustment of the hood assembly 12 are iterated in FIG. 14. The first illustration in FIG. 14 shows the full-dome or full hood 141 configuration with fasteners 144 to hold the dome in place around the water vehicle 11. The fasteners 144 may be of several styles, but shown in these diagrams is the use of Velcro® to perform the fastening function. However, those trained in the art may achieve this functionality using other methods of attachment such as tie-downs, belts with buckles, or snap connectors. The fasteners 144 may also be adapted to utilize the connecting means 21 according to the present invention. The second illustration of FIG. 14 shows the hood in a half-dome or half hood 142 configuration and again demonstrates the hood assembly fasteners 144. This formation is particularly desirable when the user of the water vehicle desires shade or wind shelter during his outdoor recreational activities. Further detail has been provided herein to specify how the hood assembly 12 is locked or held in such a set configuration. The hood assembly 12 has two equal halves that meet at the center pivot point at the oar lock so as to form a full cover or half cover over the boat. As additional security, the fabric cover of the hood assembly 12 may be secured in a selectable position above the water vehicle 11 in the half-hood and full hood formations by hood fasteners 144 which may be constructed of Velcro® or other materials. The portion of the drawing in front of the partial floor 123 is open water 145. The third illustration of FIG. 14 shows the sunroof 143 configuration for the hood assembly 12. These configurations are all adjustable, held in place, and locked via the mounting jig 51 or hood lock assembly 61. In one embodiment, the tightening of the wingnut 65 shown in FIG. 6 holds the rods 71 of the hood assembly 12 in the desired position. In another embodiment, a locking pin may provide this function. Other variations will be apparent in view of this disclosure.

Figure 15:
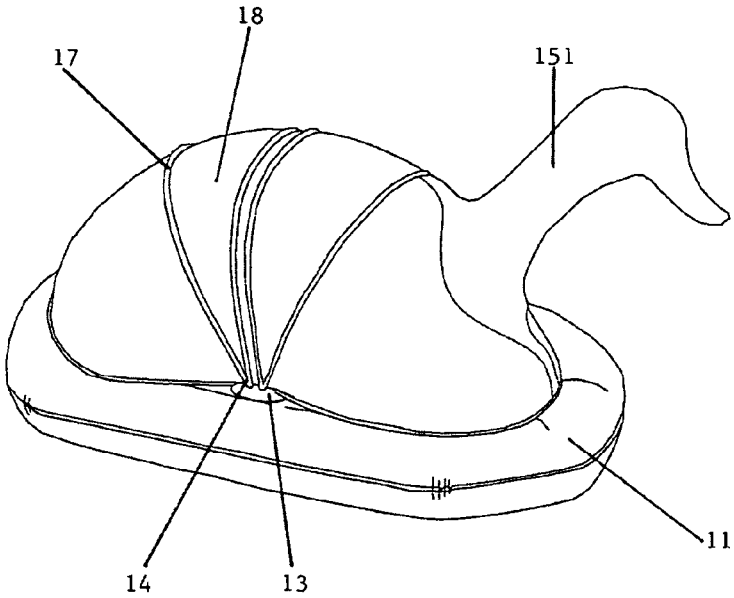
FIG. 15 shows two perspective views of a water fowl decoy shaped hood assembly according to the present invention, mounted on a water vehicle.
Figure 15:
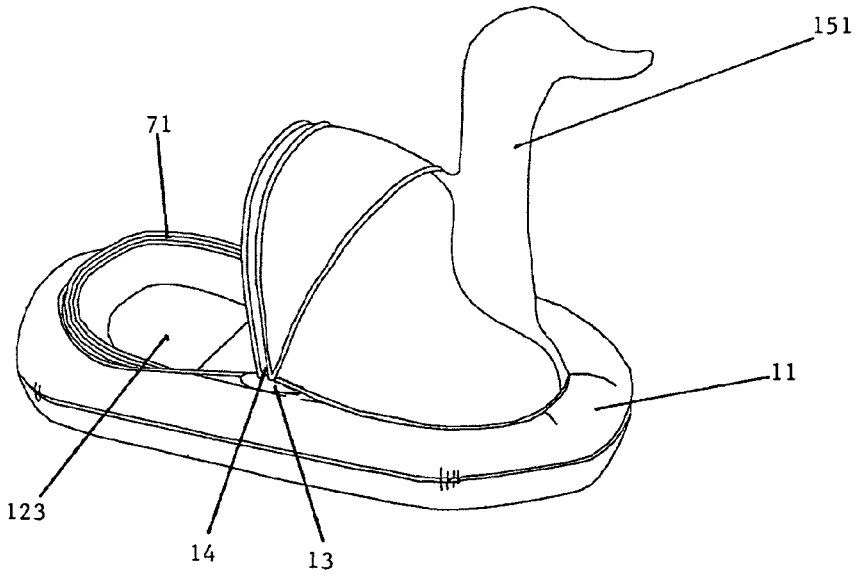

The present invention discloses a hood in the formation of an animal or waterfowl decoy. In FIG. 15, a waterfowl or goose decoy head 151 is attached to the water vehicle 11. Desirably, the hood assembly will have an extended skirt (not shown) in this embodiment which will allow an extra silhouette for the exterior tube wall of the water vehicle 11. The examples of an animal decoy embodiment as shown in FIG. 15 may also incorporate control for the head and for extra material onto the outside of the hood assembly which will allow for optional controlled movement by the user to present the appearance of waterfowl movement. This type of action is commonly referred to as flagging in the sport. To assist in creating the desired decoy effect, the head or head and neck of the mimicked waterfowl may be constructed of inflatable or non-inflatable material. The first illustration in FIG. 15 shows the hood assembly 12 closed with the goose head 151 protruding. The second illustration of FIG. 15 shows the hood assembly 12 open to the rear to allow the back half to drop when the hunter wishes to shoot or to allow the user to access the seat and other parts of the water vehicle. Variations are contemplated, allowing the water vehicle 11 to take on new shapes and appearances. Such shapes and appearances may be used to change the functional appearance of the combined hood assembly and water vehicle 11 to be used as a hunting blind or structure to be used as other types of markers such as safety markers. The examples in FIG. 1 and FIG. 15 demonstrate how the hood assembly 12 and fabric may be constructed, manipulated, painted, or dyed to change appearance for camouflage or for illumination. The present invention contemplates that the goose head or other shaped features of the hood assembly may be provided by any inflatable or light-weight, rigid or semi-rigid construction.

The frame member of the hood may also be configured in new forms or adapted for extensions which allow fabric cover designs and applications for game animal or waterfowl decoying; hunting blind, ice house or tent shelters; aesthetics such as character designs; or functional adaptations such diving insignia or safety colors displays. These kinds features enhance the functionality and aesthetics of the floatation system for applications associated with outdoor activities. The application of safety colors may have unique utility when a water vehicle is being used as a lifeboat. Fabric material patterns may consist of camouflage colors for forest, snow, straw, or sand; pronounced safety colors; flagged colors to identify the floatation system's use or exhibited appearance; or any aesthetic design for which a demand may be appreciated.

The hood cover may be constructed of numerous types of fabric or composite sewn or glued to achieve the functionality disclosed. The rods forming the skeleton of the hood should be such that the structure may bow to fit any shape or configuration of the floatation system. In the preferred embodiment, a minimum of three rods are required to support the hood, but the required structure could be provided by one rod or as many rods as desired. In one embodiment, the rod structure may be designed from metal or fiber composites to achieve a support structure and may be a solid or segmented rod. In another embodiment, the hood will be supported by rod structures made of inflatable tubes inseparable from or within the hood cover. The binding of the hood cover may be achieved through sewn or glued seams. In yet another embodiment of the rod and hood cover combination, the rods may be inflatable capsules that provide support to the hood. The rods may be within the fabric, outside or inside the hood. Rods disposed outside of the hood cover may allow for the addition of a rain fly over the rods. One skilled in the art will appreciate that the design is such that it may be constructed from many types of materials to achieve similar or the same functionality.

Other embodiments and uses of the invention will be apparent to those skilled in the art from consideration of the specification and practice of the invention disclosed herein. As will be easily understood by those of ordinary skill in the art, variations and modifications of each of the disclosed embodiments can be easily made within the scope of this invention as defined herein.

It is further intended that any other embodiments of the present invention which result from any changes in application or method of use or operation, method of manufacture, shape, size, or material which are not specified within the detailed written description or illustrations contained herein yet are considered apparent or obvious to one skilled in the art are within the scope of the present invention.

I claim:

1. An improved floatation system having an inflatable tube with a tube wall, wherein the improvement comprises:

a network of connecting means affixed to the inner-tube wall;

an integrated oar lock assembly and a hood mounting and swivel means the oar lock assembly mounted on the tube wall;

the swivel means attached to the oar lock assembly whereby a hood assembly is attached to the tube, the swivel means further comprising a pivot point and a friction applicator;

the hood mounting and swivel means being removable, a motor mounting means whereby a motor is mounted to the tube;

a motor rotating means couples with the motor mounting means to translate the motor through a vertical axis between a stowage position and a use position; and a motor control means whereby the motor rotating means and the motor are controlled.

2. The improved floatation system of claim 1, the network of connecting means further comprises a network of woven straps.

3. The improved floatation system of claim 1, the hood assembly further comprises at least three rods and a fabric cover.

4. The improved floatation system of claim 1, the motor rotating means translating through 180 degrees of a vertical axis.

5. An improved floatation system having an inflatable tube with a tube wall having a proximal surface and a distal surface and an oar lock, the tube further having at least one seat platform, wherein the improvement comprises:

a connecting means affixed to the proximal surface of the tube wall;

a hood mounting and swivel means whereby a hood is attached to the oar lock of the tube;

a motor mounting means whereby a motor is mounted on the tube;

a motor rotating means couples with the motor mounting means to translate the motor through a vertical axis in order to achieve alternative direction selection; and a motor control means whereby the motor rotating means and the motor are controlled from the proximity of the seat platform.

6. The improved floatation system of claim 5, the connecting means further comprises a network of woven straps.

7. The improved floatation system of claim 5, the hood assembly further comprises at least three rods and a fabric cover.

8. The improved floatation system of claim 5, the motor rotating means translating through 180 degrees of a vertical axis.

9. The improved floatation system of claim 5, wherein the connecting means removably attaches a substantially planar surface.

10. An improved floatation system wherein an inflatable tube with a tube wall, the tube further having a bottomless interior and a seat platform traversing the bottomless interior, wherein the improvement comprises:

a connecting means affixed to the tube wall;

a hood mounting and swivel means whereby a hood is attached the tube;

a motor mounting means whereby a motor is mounted on the tube distally from the seat platform;

a motor rotating means whereby a motor may be translated through a vertical axis;

a motor control means whereby the motor rotating means and the motor are controlled from the proximity of the seat platform; and wherein the connecting means removably attaches a substantially planar surface to close at least a portion of the bottomless interior.

11. The improved floatation system of claim 10, the connecting means further comprises a network straps woven at ninety-degree angles and affixed to lie flush along the entire interior circumference of the tube wherein the netting forms a connecting means whereupon accessories may be attached to the inflatable tube.

12. The improved floatation system of claim 10, the hood assembly further comprises at least three rods and a fabric cover.

13. The improved floatation system of claim 10, the motor rotating means translating through 180 degrees of a vertical axis.

14. The improved floatation system of claim 10, the substantially planar surface being formed and constructed of an inflatable material.

15. In a floatation system having an inflatable tube with a tube wall and at least one seat platform, a motor mount system comprising:

a motor mount having a frame member;

the motor mount being coupled with a rudder means, wherein the rudder means is affixed to a bracket;

a motor attached by a hinging mechanism to the motor mount;

wherein the hinging mechanism restricts the motor translation through a vertical axis;

wherein the motor translation is controlled by the cooperation of at least a first control and a second control;

the first control requiring a manipulation by an outside force such as a user in the tube;

the second control reacts in a manner responsive to the manipulation of the first control;

wherein the hinging mechanism supports the motor during operation.

16. The improved floatation system of claim 15, wherein the motor translates through 180 degrees of the vertical axis.

17. The improved floatation system of claim 15, wherein the first control is a lever and the second control is a cable coupled with a wheel affixed to the hinging mechanism.

18. An improved floatation system having an inflatable tube with a tube wall, wherein the improvement comprises:

a hood of sufficient sizing and volume to enclose the tube and accommodate at least one human occupant;

a plurality of rods attached to the hood and providing integrity to the hood;

a mounting jig affixed to an oar assembly mounted on the tube wall;

a plurality of receiving structures rotatably joined with the mounting jig and releasably attached to the rods;

the mounting jig further providing a pivot point for the rods whereby the mounting jig and rods comprise a friction applicator wherein the mounting jig and rods permit selectable position adjustment of the hood;

the selectable position adjustment comprising options of half-dome, partial coverage, or full-coverage.

19. The improved floatation system of claim 18, wherein the hood is shaped and formed as a water foul.

20. The improved floatation system of claim 18, wherein the hood further comprises at least one cover opening having an access flap.

21. The improved floatation system of claim 20, wherein the cover opening is a door.

22. An improved floatation system wherein an inflatable tube with a tube wall, the tube further having a bottomless interior and at least one seat platform traversing the bottomless interior, wherein the improvement comprises a substantially planar, inflatable surface which may be removably attached to the tube by a network of connecting means adhered directly to the tube wall, the connecting means adhered directly to the tube wall at multiple and various complementary elevations and stations around an inner circumference of the tube wall;

wherein the connecting means further comprise a network of straps;

the substantially planar, inflatable surface selectably covering at least a portion of the bottomless interior.

23. The improved floatation system of claim 22, wherein the substantially planar surface may be implemented to convert the floatation system to a vehicle with selectably a bottom, center, or surface deck.

24. The improved floatation system of claim 22, wherein the substantially planar surface covers the entire portion of the bottomless interior.

25. An improved floatation system having an inflatable tube with a tube wall, the tube further having a bottomless interior, and at least one seat platform, wherein the improvement comprises:

a plurality of connecting means affixed directly to the tube wall at various and complementary elevations and stations around the tube;

a motor mount to connect a motor to the tube or seat platform;

a motor rotating means whereby the motor is hingedly attached to the motor mount;

a motor actuating means which translates the motor 180 degrees from a stowage position to an operating position;

a motor control means is disposed in proximity with the seat platform the motor control means comprising a set of control mechanisms intercommunicating with the motor actuating means;

a substantially planar, inflatable surface which may be removably attached to cover at least a portion of the bottomless interior;

a hood assembly attached to a hood mounting and swivel means affixed to an oar assembly on the tube;

the hood assembly comprising at least three rods and a fabric cover;

the hood mounting and swivel means further comprising a structural receiver for the rods and a rigid pivot point upon an uppermost portion of the tube wall.

26. The improved floatation system of claim 25, wherein the rigid pivot point is a mounting jig.

27. The improved floatation system of claim 26, wherein the mounting jig further comprises female receiving cylinders to engage the rods.

28. An improved floatation system wherein the floatation system comprises an inflatable tube having an interior circumference and an exterior circumference, the improved floatation system comprising:

straps woven at ninety-degree angles in a webbed netting, the netting affixed to the tube in a manner to allow it to lie flush along the circumference of the tube, wherein the netting forms a connecting means whereupon accessories may be attached to the inflatable tube.

29. The improved floatation system of claim 28, the netting further lying along the entire interior circumference of the tube.

30. The improved floatation system of claim 28, the netting further lying along the entire exterior circumference of the tube.

31. The improved floatation system of claim 28, wherein the straps are constructed of a material with sufficient strength to hold a significant load.

32. The improved floatation system of claim 28, wherein the straps are flexible enough to allow engagement with a connecting instrument to install an accessory to the floatation system.

33. The improved floatation system of claim 32, wherein the connecting instrument further comprises snaps, hooks, brackets, clips, or lacing.

34. In a floatation system having an inflatable tube, a motor mount system comprising:

a motor mounting means whereby a motor is mounted to the tube, a motor rotating means, wherein the motor rotating means couples with the motor mounting means to translate the motor through 180 degrees of a vertical axis.

* * * * *